US005938194A

United States Patent [19]

Coombs et al.

[11] Patent Number: 5,938,194

[45] **Date of Patent: *Aug. 17, 1999**

[54] MAILBOX WITH SPRING BIASED GATES

[75] Inventors: Peter M. Coombs, Tustin, Calif.; Klaus Thogersen, Klampenborg, Denmark

[73] Assignee: Gradco (Japan) Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/325,159

[22] Filed: Oct. 21, 1994

[51] Int. Cl.[6] ..... B65H 39/10

[52] U.S. Cl. ..... 271/297; 271/305

[58] Field of Search ..... 271/297, 305

[56] References Cited

U.S. PATENT DOCUMENTS 4,116,429 9/1978 Van Bukirk et al. ..... 271/297 X
4,299,382 11/1981 Ichikawa ..... 271/297 X
4,428,572 1/1984 Burke ..... 271/305 X
5,013,028 5/1991 Tajima et al. ..... 271/305

OTHER PUBLICATIONS

Barthulet et al., "Sheet Distributors for MultiBin Collators," Dec. 1981, 2BM Tech. Disc. Bulle, vol. 24, No. 7B, pp. 3768–3770.

*Primary Examiner*—Boris Milef
*Attorney, Agent, or Firm*—Newton H. Lee, Jr.

[57] ABSTRACT

A sorter mailbox has a sheet transport for moving sheets through a feed path to a set or sets of vertically spaced receiver trays having sheet deflecting gates which are actuated so as to sowing toward or into an open sheet deflecting position so as to contact with light spring pressure a sheet moving through the sheet feed path but to open to deflect the sheet into a selected tray from the sheet feed path.

2 Claims, 6 Drawing Sheets

MAILBOX WITH SPRING BIASED GATES

BACKGROUND OF THE INVENTION

In the use of electronic printers in the office, particularly in the case of networked printers, the output from which may be designated for different recipients, it has become desirable that random access sorting devices be employed for segregating different jobs or different sets of sheets designated for different individuals.

Devices which are useful for these purposes are wall known and have employed various means for transporting the sheets from the printers to selective receiver trays. Such devices are typically sorting machines useful also with office copiers to collate sets of copies produced by the copier.

THE PRIOR ART

Examples of the prior art are shown in Lawrence U.S. Pat. No. 3,937,459 granted Feb. 10, 1976 and Hirota et al U.S. Pat. No. 5,267,729 granted Dec. 7, 1993 wherein belts are employed in a sheet transport mechanism to carry the successive sheets along a sheet path in which are disposed normally closed gates which may be selectively opened to deflect a sheet into a receiver tray.

Other examples of sorters useful an mailboxes which employ a transport system involving food rolls and nip rolls are shown in, for example, Lawrence U.S. Pat. No. 4,691,914, granted Sep. 8, 1957 and in Lawrence U.S. Pat. No. 5,346,205 granted Sep. 13, 1994. Those latter types of sorting devices are relatively complicated and involve driven gear sets for driving the sheet feeding rolls and respective individual actuator mechanisms for momentarily moving the sheet deflector gates to the open position or moving a sheet deflecting roll to a position at which the sheets are deflected into the respective trays in a random manner.

SUMMARY OF THE INVENTION

The present invention contemplates a relatively simple and inexpensive sheet transport system in which successive sheets are supplied to selected trays and deflected by gates into the trays by a novel gate opening mechanism system requiring only a single actuator device for a complete set of gates.

In one form, there are multiple sets of trays with gates which can be independently operated to allow the feeding of sheets of a length equal only to about the height of the respective sets of spaced trays.

According to the present invention, the gates or deflectors are pivotally mounted in the usual manner so as to be actuated between the normally closed and open positions to selectively deflect a sheet into a selected tray, wherein at the appropriate location along the sheet food path, all of the gates are simultaneously resiliently urged towards the open position, so that the gates downstream in the sheet feed path from the selected gate which is to deflect a sheet into a tray are all resiliently biased to the open position, but the gates upstream from the selected gate, while being biased towards the open position, are retained in the closed position by engagement with the sheet traveling through the sheet path, and, as the sheet is deflected by the selected open gate into the selected tray, that selected gate is hold in the open position by the passage of the sheet into the tray, until the trailing edge of the sheet has passed the selected open gate.

With such a simple construction, all of the trays are actuated simultaneously by a single actuating mechanism which can be activated by control means to select a gate which is to deflect the sheet into a selected tray, but the upstream gates will be hold closed by the sheet passing thereby as the leading edge of the sheet is deflected into the selected tray.

DESCRIPTION OF THE PREFERRED EMBODIMENT

Figure 1:
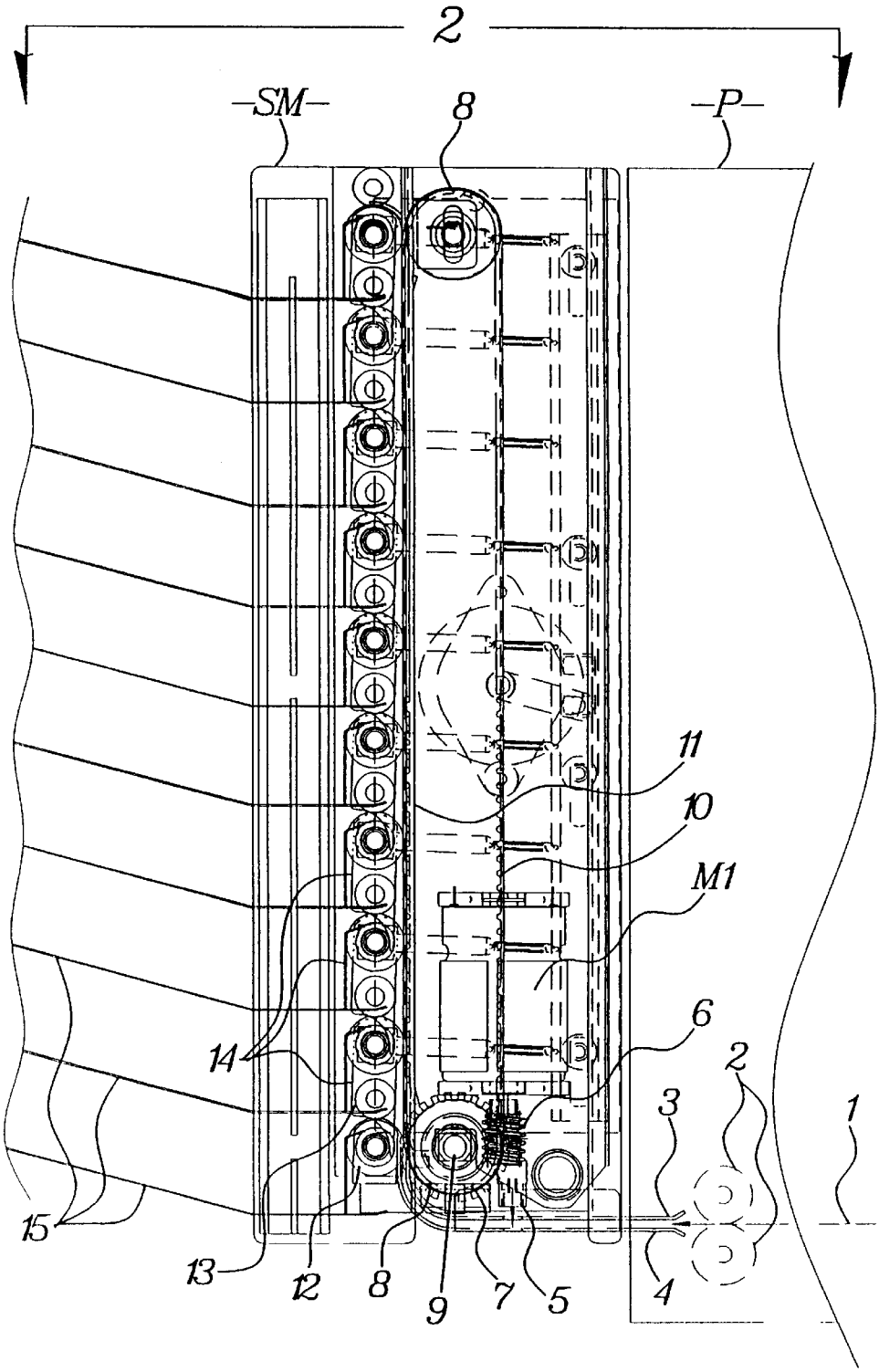
FIG. 1 is a side view, with the side cover removed, showing a sorter mailbox in accordance with the invention applied to a printer.
Figure 2:
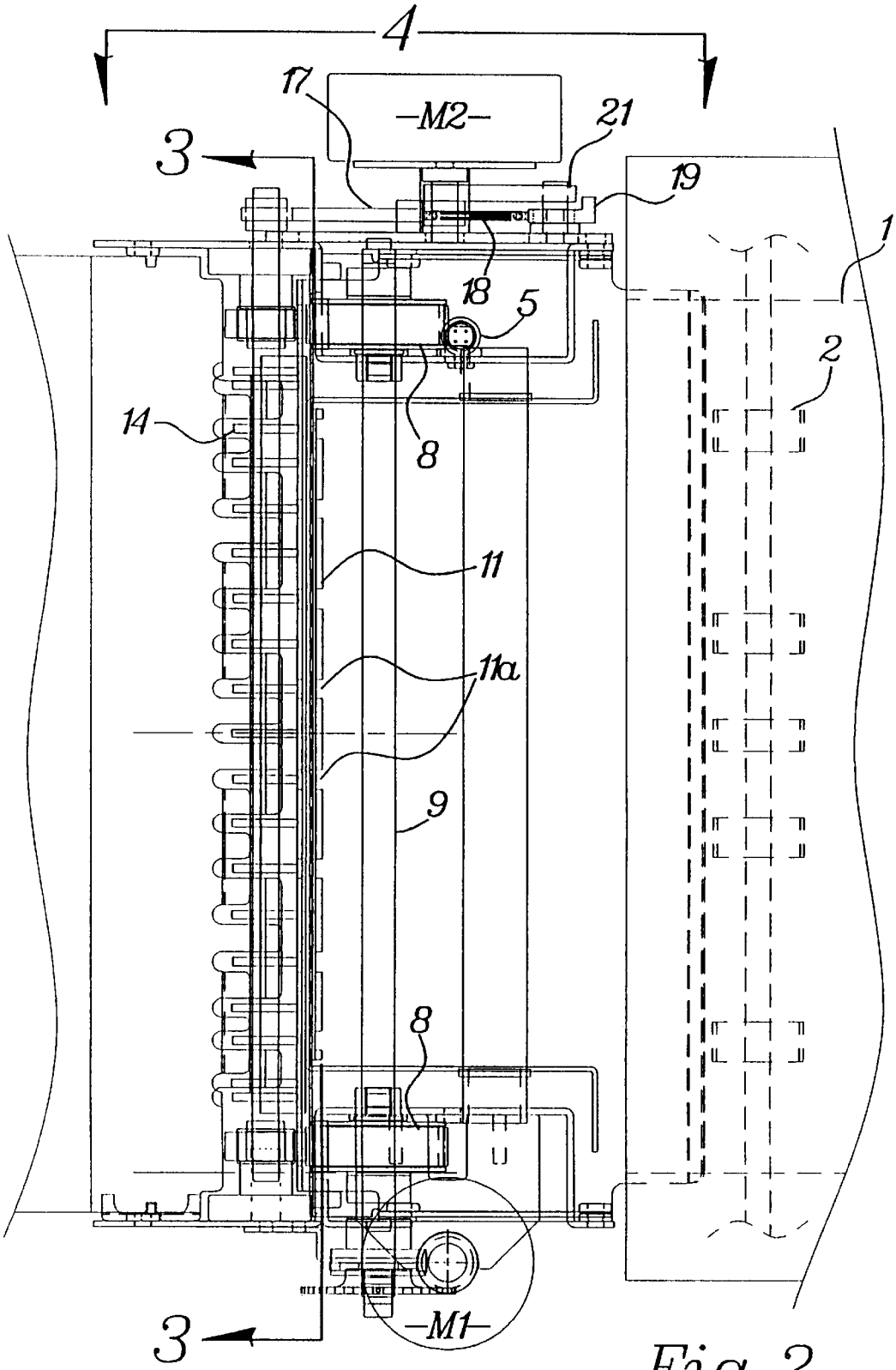
FIG. 2 is in a top plan view thereof.
Figure 3:
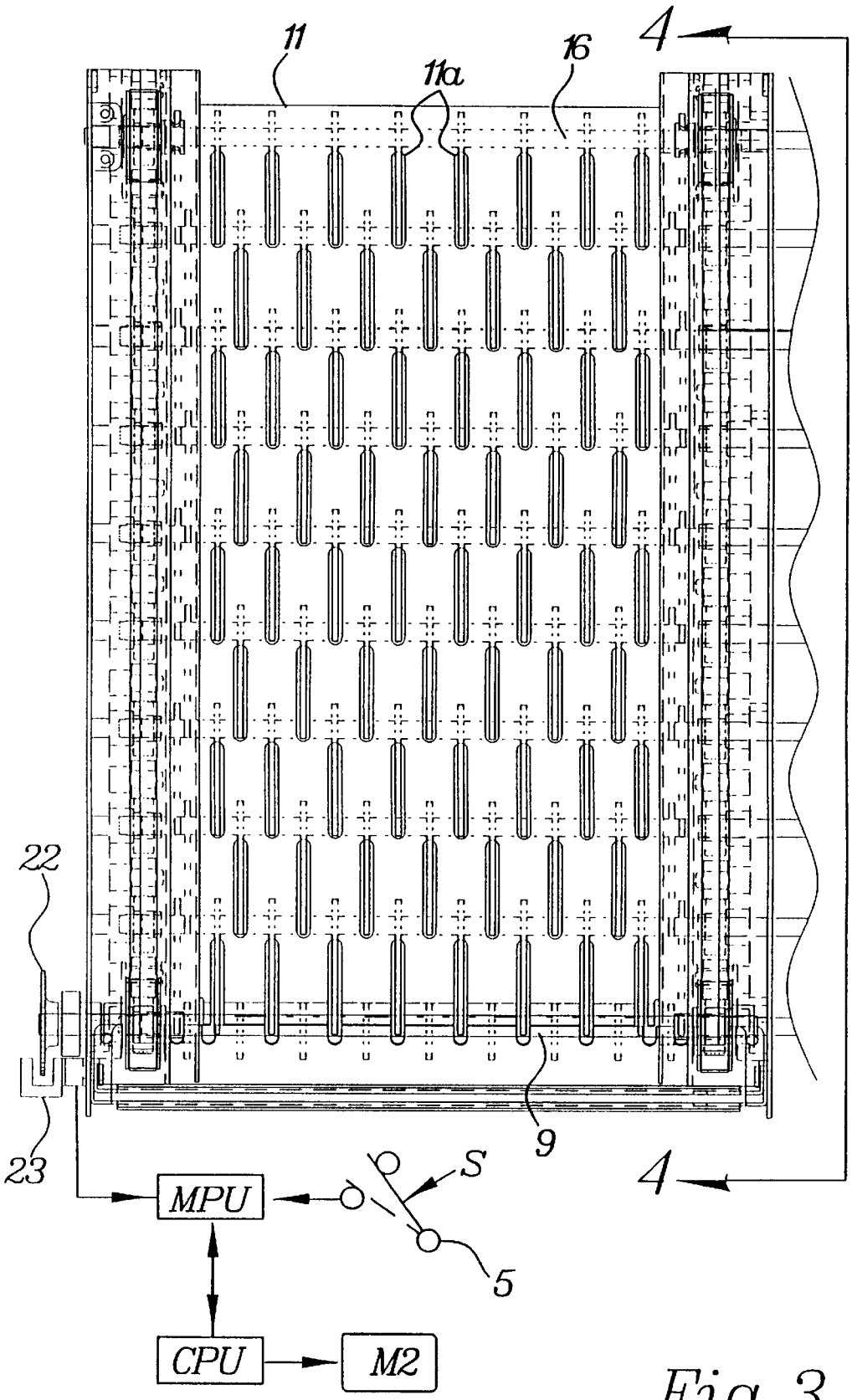
FIG. 3 is a vertical section on the plane of the line 3—3 of FIG. 2.

Referring to FIGS. 1–3, a sorter mailbox SM is illustrated in association with a printer P.

Printer P is adapted to produce printed sheets 1 which are supplied by output rolls 2 to an infeed guide 3,4 for the sorter mailbox. Successive sheets are supplied to the guide and the leading edge of the sheet will be detected by a photosensor switch 5.

A drive motor M1 is adapted to drive through suitable gearing such as a worn 6 and a worn gear 7. A pair of belt pulleys 8 at opposite ends of a cross shaft 9, and a transport belt 10, one at each side of the assembly, is trained about the pulleys 8 with a sheet engaging run extending upwardly in sliding engagement with a vertical plate 11 which, as seen in FIG. 3, has rows of horizontally spaced,vertical slots 11*a*. Drive rollers 12 and idler rollers 13 are spaced vertically with the drive rollers 12 in frictional confronting engagement with the sheet engaging run of the belts to cause the sheets being transported along the feed path defined by the belts and drive rollers.

Associated with each set of drive rollers 12 and 13, is a pivoted gate or deflector 14 which is adapted when moved to the open position, as will be later described, to deflect a sheet into one of the vertically spaced sheet receiving trays 15. The gates 14 extend across the distance between the sheet transporting means at opposite sides of the apparatus.

Figure 4A:
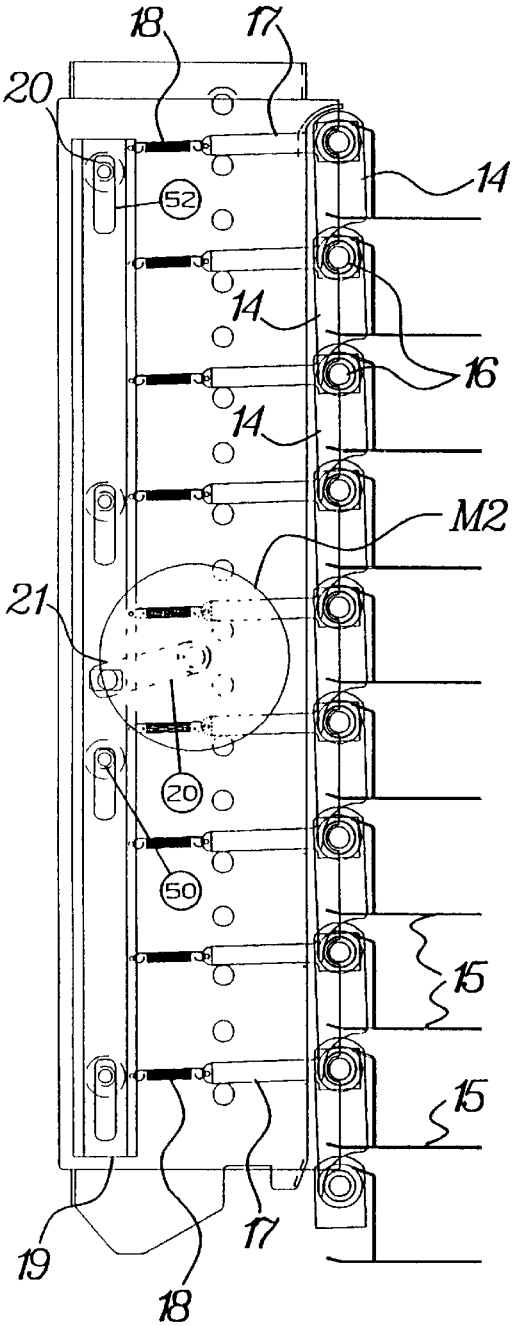
FIG. 4*a* is a vertical section as viewed on the line 4—4 of FIG. 2, with the cover removed, showing the gates in the normally closed condition.
Figure 4B:
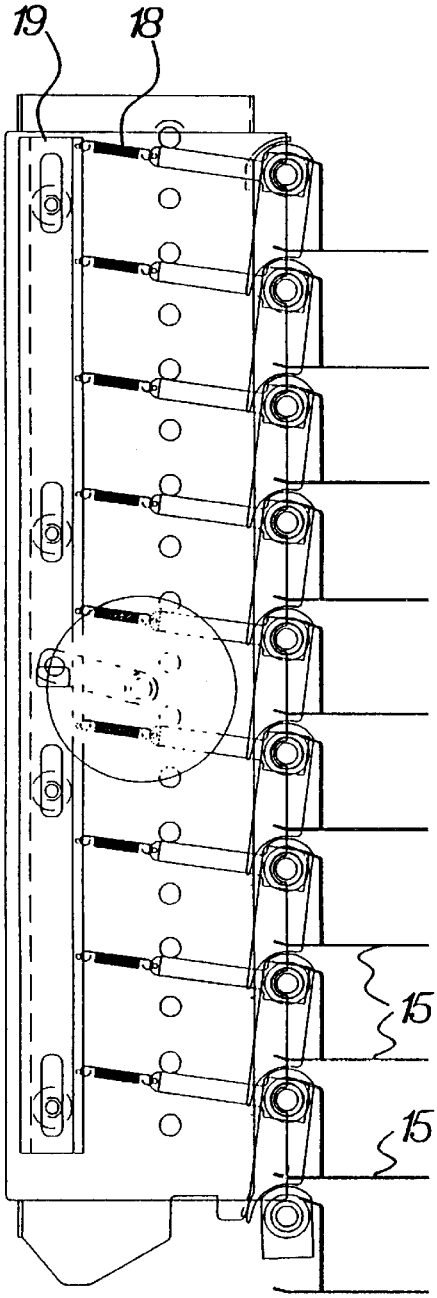
FIG. 4*b* in a view corresponding to FIG. 4*a*, but showing the gates open.

Referring to FIGS. 4*a* and 4*b*, it will be seen that the gates 14 are each mounted on a rockable shaft 16 and each shaft 16 has an arm 17 connected by a tension spring 18 to a vertically shiftable slide 19 guided by shoulder pins 20 in the frame and vertically shiftable by a crank arm 21 of a motor M2 so as to be shifted between the lover position shown in FIG. 4*a* and the upper position shown in FIG. 4*b*.

In the lover position of FIG. 4*a* it will be seen that each of the gates 14 is in a closed position so that a sheet moving vertically with respect to the trays will move from the guide 3,4 previously referred to, in an upward direction without interference from the gates, but when the arm 21 is moved to the position of FIG. 4*b*, moving slide 19 upwardly, the gates are all opened and hold in the open position by the tension of the springs 18, so that sheets may be fed through the food path to a selected tray, as will be later described.

As best seen in FIG. 3, at one and of the cross shaft 9, which drives the sheet feeding belts, is a code wheel 22 cooperative with an optical sensor 23 and the photosensor 5, through microprocessor unit MPU to detect the speed of paper movement and, therefore, the location of the lead edge of the paper along the feed path is detected.

A control processing unit CPU, in combination with the microprocessing unit MPU, provide means which enable the control of the mailbox in such a fashion that depending upon the position of the paper along the feed path, as detected by the MPU, the deflector actuator motor M2 will be energized so as to cause a sheet to be deflected into a selected tray.

Figure 5E:
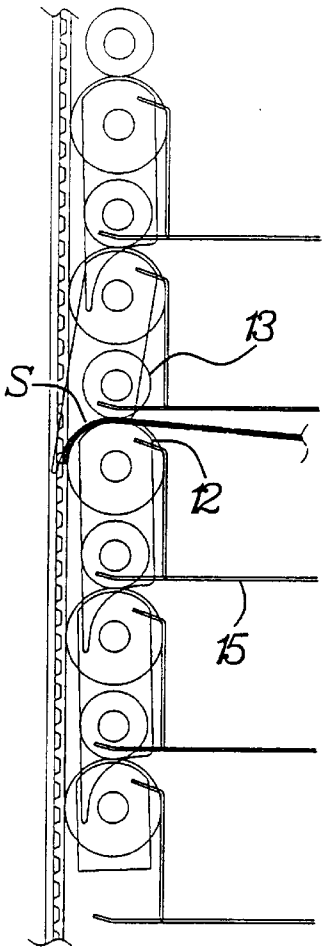
FIGS. 5*a*–5*e* are fragmentary detail views illustrating the progressive transport of a sheet into a selected tray.
Figure 5D:
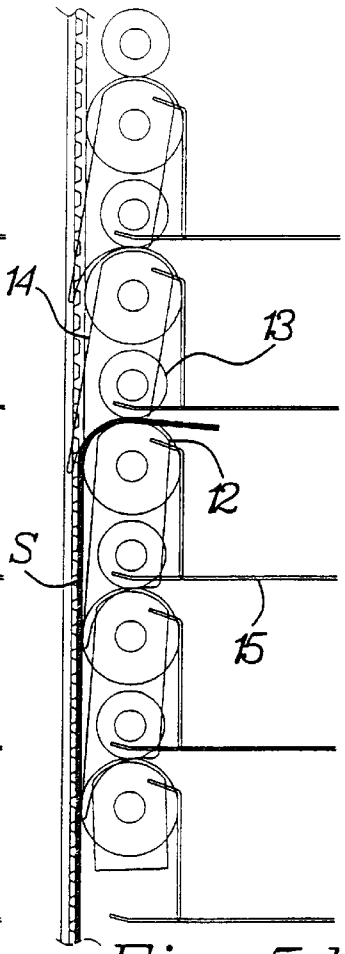
Figure 5C:
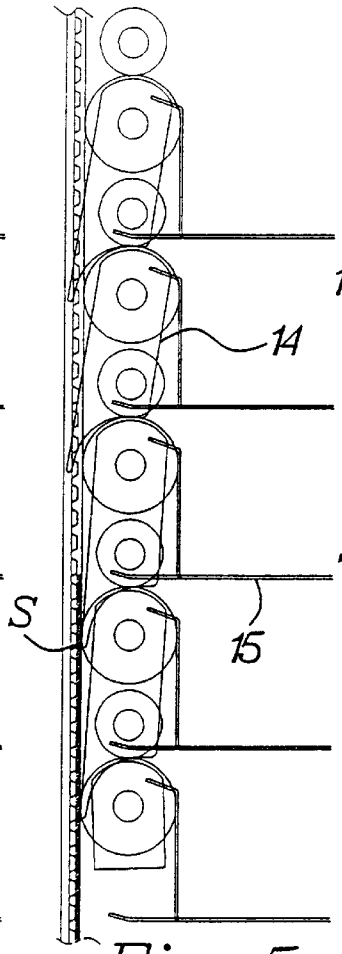
Figure 5B:
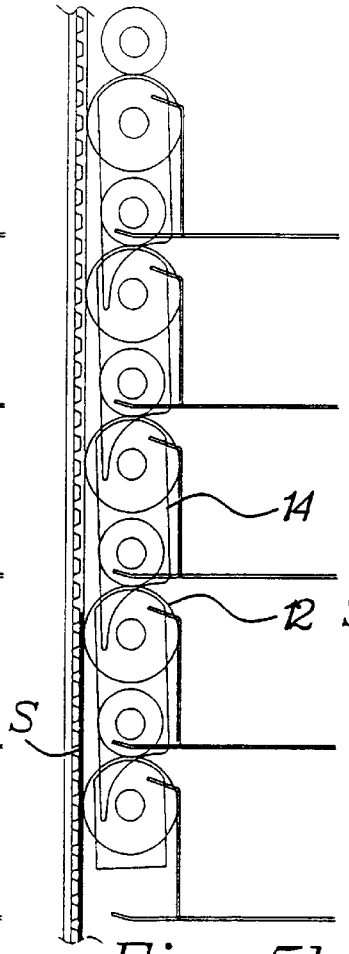
Figure 5A:
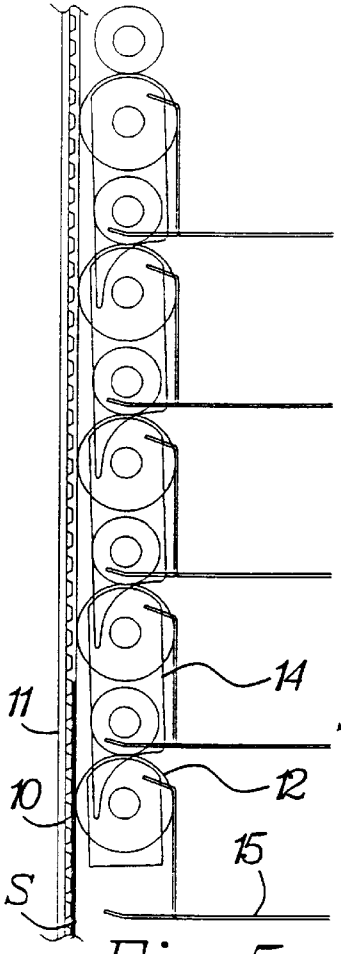

Referring to FIGS. 5*a*–5*e*, the mode of operation of the MPU and CPU and actuation of the gates by the motor M2 is more clearly illustrated. As seen in FIG. 5*a*, a sheet of paper S is shown as being transported upwardly in the feed path between the belt 10 and the slotted back plate 11 past normally closed gates 14 associated with the respective trays 15 into which the sheet is to be selectively diverted by one of the deflectors. In this view, the paper is being moved upwardly by the belt and food roller 12 an a result of the pressure applied between the belt and the lowermost feed rollers so that the leading edge of the sheet has passed beyond the lowermost tray 15.

In FIG. 5*b*, the leading edge of the sheet is pressed against the belt and the back plate by the second lowermost roller 12 and the leading edge of the paper has also passed the lower and of the second lowest deflector 14.

Now referring to FIG. 5*c* and under the condition that the intention is that the paper be deflected into the third lowermost tray 15 by the third lowermost gate 14, the control signal from the MPU will cause the motor M2 to shift the slide 19 as shown in FIG. 4 to the uppermost position at which the springs 18 pull the gate arms 17 and apply a light resilient load on the lower ends of the first and second lowermost gates of FIG. 5*c*. To move those lower ends toward an open position so as to lightly engage the paper sheet. However, the third lowermost gate 14 in FIG. 5*c* is allowed to open under the light spring force so that as the sheet 8 continues upwardly, as seen in FIG. 5*d*, the leading edge is deflected by gate 14 between the food roll 12 and the companion Idler or nip roll 13 into the third lowermost tray 15 under the continuing drive imparted by the feed roll 12.

Following entry of the lead edge of the sheet between the rolls 12 and 13, as shown in FIG. 5*d*, the motor M2 may be de-energized and allow the lover gates to return to their normally closed positions. However, tho third lowermost gate, an seen in FIG. 5*e*, will be hold open by the sheet of paper S until the trailing edge enters the tray.

it will be recognized that if a second sheet of paper S were to be destined for any tray, either below or above the, paper shown in FIG. 5*e*, such second sheet of paper may be in the sheet path at any position of the second sheet behind the trailing edge of the sheet shown in FIG. 5*e*.

Since the sheet of paper P in FIG. 5*e*, upon movement of its trailing edge through the feed roll 12 and nip roll 13, allows automatic closure of the gate 14, and the motor M2 may again be actuated to re-open all of the gates above the point at which the leading edge of the paper is compressed against the belt and the lowermost feed roll associated with the next tray into which a sheet is to be fed.

Figure 6A:
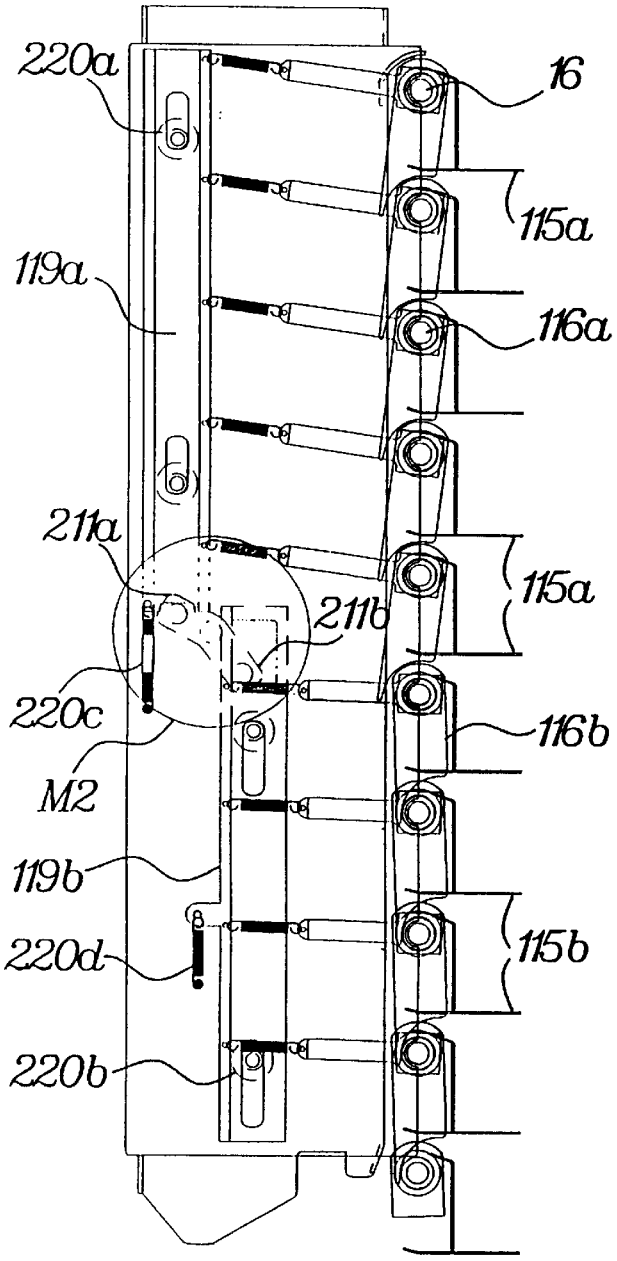
FIG. 6*a* is a view-showing-a modified construction in which upper and lower sets of gates can be separately actuated between the normally closed positions and the open positions and showing the upper met of gates open.

Referring to FIG. 6*a*, a modified arrangement of the invention is illustrated In which the sheet receiver in adapted to direct sheets to separate sets at trays designated as 115*a* and 115*b* which are associated with separate sets of deflector gates 116*a* and 116*b*. The gates 116*a* and 116*b* are connected to a slide 119*a* while the gates 116*b* are connected to a slide 119*b*. The slides are supported for vertical movement by rollers 220*a* and 220*b* and are normally biased downwardly by springs 220*c* and 220*d*.

In this construction the motor M2 has a double crank arm 211*a* and 211*b* connected to the respective slides 119*a* and 119*b*. Thus on activation of the motor in one direction, slide 119*a* is moved upwardly as shown in FIG. 6*a*, so that the spring tension holds the sheet deflector gates 116*a* in the open position while the gates 116*b* remain closed.

Figure 6B:
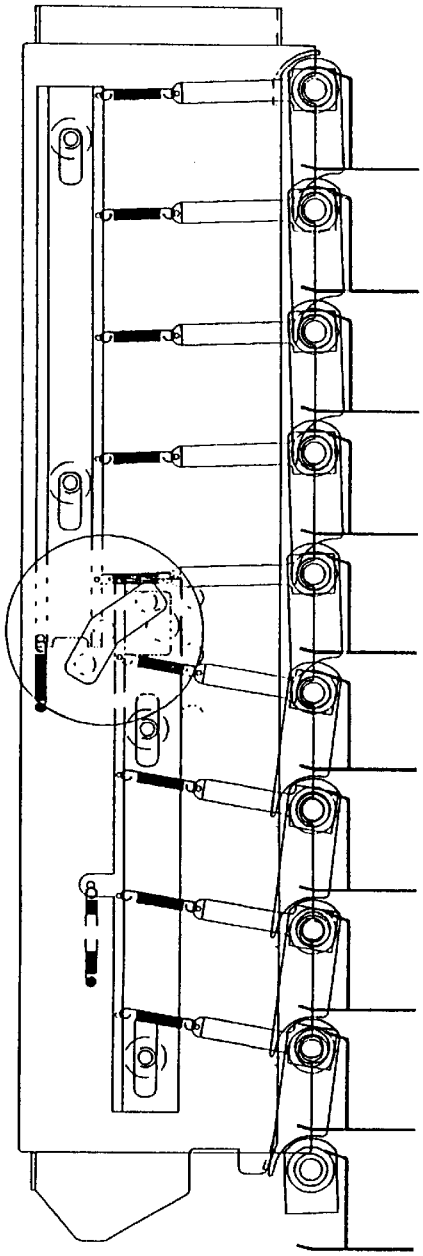
FIG. 6*b* is a view corresponding to FIG. 6*a* but showing the upper sets of gates closed and the lower sets of gates open.

In FIG. 6*b*, it will be seen that the relative positions of the slides 119*a* and 119*b* has been reversed upon opposite activation of the motor M2 and the double crank arm, so that gates 116*a* are closed, but, gates 116*b* are opened.

In the use of the separate sets of trays and spring biased gates shown in FIGS. 6*a* and 6*b* it will be recognized that short sheets may be passing through the vertical sheet transport simultaneously and due to the inter-sheet gap, can be directed to the same selected tray or to separately designated trays. In the case just mentioned, or in situations with printer hosts performing at high sheet feed rates, it is possible to use one motor M2 and double crank arm for each pair of sets of trays where more than two sets of gates and trays are employed.

We claim:

1. In a sheet receiver for use with a printer or copier comprising: an array of vertically spaced and horizontally extended trays for receiving sheets, pressure responsive sheet transport means for moving sheets vertically in a feed path along sheet inlet ends of said trays, gates at the respective sheet inlet ends of said trays and normally in a closed position allowing vertical transport of sheets in said feed path past the sheet inlet ends of said trays and selectively swingable to positions to deflect a sheet into a selected tray, the improvement wherein said sheet transport means includes sheet feed pressure rollers engaged with said sheets at the sheet inlet end of each tray and a nip roller in pressure contact with each feed pressure roller for carrying a sheet to the respective trays, gate actuating means operable to swing said gates simultaneously toward a sheet deflecting position into resilient pressure contact with a sheet moving in said feed path and a sheet deflecting position at a selected tray in advance of the leading edge of said sheet moving in said path and said gate actuating means including a motor, a vertically extended slide operable by said motor for reciprocation, and springs connected at respective first ends thereof to said slide and at respective seconds thereof to said gates to move said gates to said positions to deflect a sheet upon energization of said motor to move said slide in one direction, said gate actuating means also including a control means to actuate said motor to swing said gates toward said sheet deflecting position, said control means having means for detecting the leading edge of a sheet moving in said feed path and actuating said motor depending upon the position of the leading edge of said sheet in said feed path for deflecting a sheet into a selected tray when said gates swing toward said sheet deflecting position.

2. In a sheet receiver for use with a printer or copier comprising an array of vertically spaced and horizontally extended trays for receiving sheets, sheet transport means for moving sheets vertically in a feed path along sheet inlet ends of said trays, gates at the respective sheet inlet ends of said trays and normally in a closed position allowing vertical transport of sheets in said feed path past the sheet inlet ends of said trays and selectively swingable to positions to deflect a sleet into a selected tray, the improvement wherein gate actuating means are operable to swing said gates simultaneously toward a sheet deflecting position into resilient pressure contact with a sheet moving in said feed path and a sheet deflecting position at a selected tray in advance of the leading edge of said sheet moving in said path, said gate actuating means including selectively operable motor means, a pair of vertically extended slides connected to said motor means and to certain of said gates and to other of said gates, respectively, to separately move said certain gates and said other gates to said positions to deflect a sheet upon selective energization of said motor means to selectively move said pair of slides.

* * * * *